United States Patent [19]

Theisen et al.

[11] Patent Number: 4,614,851

[45] Date of Patent: Sep. 30, 1986

[54] CONTACT SEQUENCING ARRANGEMENT FOR ROTARY DOUBLE BREAK SWITCH

[75] Inventors: Peter J. Theisen, West Bend; James J. Rusenko, Milwaukee; Frank Navratil, Jr., Thiensville, all of Wis.

[73] Assignee: Eaton Corporation, Cleveland, Ohio

[21] Appl. No.: 704,111

[22] Filed: Feb. 21, 1985

[51] Int. Cl.[4] ..... H01H 33/14

[52] U.S. Cl. ..... 200/146 R; 361/3

[58] Field of Search ..... 200/146 R, 145, 150 C; 361/3, 9

[56] References Cited

U.S. PATENT DOCUMENTS

| | | | |
|---|---|---|---|
| 1,807,526 | 5/1931 | Hammerly | 200/145 |
| 2,620,417 | 12/1952 | Lewis | 200/244 |
| 3,154,656 | 10/1964 | Gussow et al. | 200/145 |
| 3,632,929 | 1/1972 | Butler | 200/145 R |
| 4,459,629 | 7/1984 | Titus | 361/3 |

FOREIGN PATENT DOCUMENTS

| | | | |
|---|---|---|---|
| 142621 | 3/1979 | Fed. Rep. of Germany | 200/146 R |

*Primary Examiner*—Robert S. Macon

*Attorney, Agent, or Firm*—C. H. Grace; L. G. Vande Zande

[57] ABSTRACT

Stationary contacts (12) of a multi-pole disconnect or safety switch are arranged to be engaged by one of a rotatably movable bridging contact (2) before engagement of the other end thereof with a second set of stationary contacts (10). Stationary contacts (12) of adjacent switch poles are positioned on alternate ends for increasing the phase-to-phase failure distance, and one stationary contact (10*a*) may be arranged to close one or two milliseconds late to produce single phasing for a short time under fault current conditions during which time current limiting fuses (14) begin to open the circuit.

5 Claims, 1 Drawing Figure

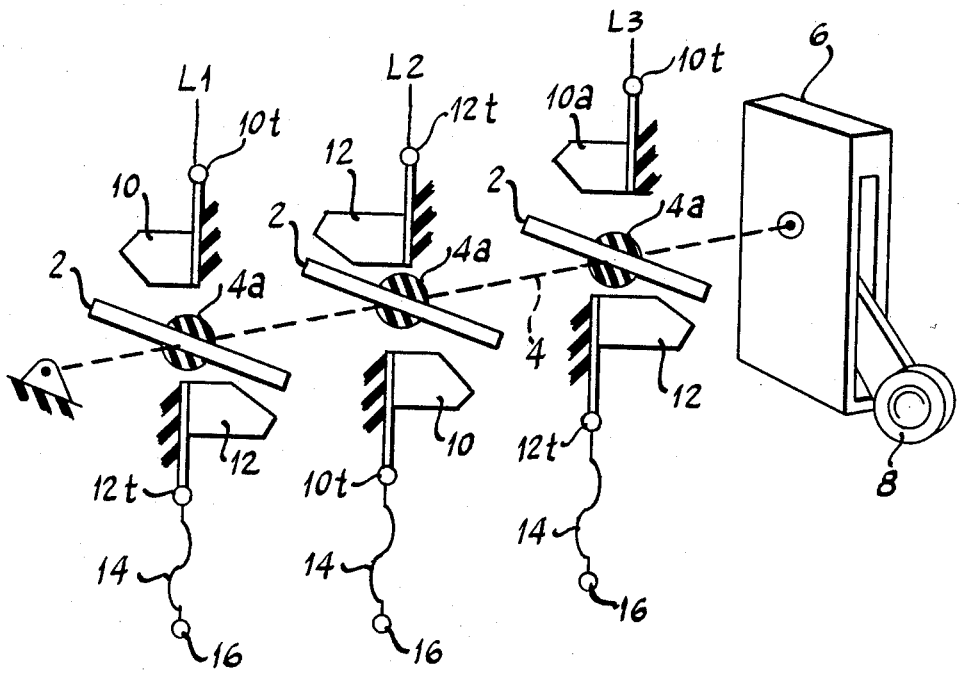
L1
10t
10
2
4a
12
12t
14
16
L2
12t
12
2
4a
10
10t
14
16
L3
10t
10a
2
4a
4
12
12t
14
16
6
8

CONTACT SEQUENCING ARRANGEMENT FOR ROTARY DOUBLE BREAK SWITCH

BACKGROUND OF THE INVENTION

This invention relates to double break electric switches of the type having a bridging contact rotatable to engage stationary contacts at its opposite ends. More particularly, this invention relates to a contact arrangement for such switches wherein electrical arcing which occurs upon contact closing and contact opening is reduced and controlled.

The invention is particularly adapted for use in switching devices of the type commonly known as disconnect switches or safety switches. Conventional double break safety switches make simultaneous contact at both ends of the bridging contact. When closing the contacts of a switch of this type on a high current, such as a fault current condition, the contacts tend to arc at both ends of the bridging contact. Forces related to the fault current can keep the contacts from closing, at least momentarily. Moreover, the two arcs dissipate a high level of energy which can cause phase-to-phase flashover and other failures.

SUMMARY OF THE INVENTION

The invention disclosed herein provides a sequential contact closing arrangement for a double break rotatably movable bridging contact which causes a circuit to be completed at one end of the bridging contact before completing the circuit at the other end of the bridging contact. This arrangement permits the first end of the bridging contact to establish contact without influence of a fault current. All electrical arcing is concentrated at the other end of the bridging contact which establishes its contact and completes the circuit subsequent to contact closure of the first end. Accordingly, only one arc occurs in the double break switch of this invention, thereby reducing the arc dissipated energy by one-half over that in conventional double break switches. This invention also provides a multi-pole switch of the aforementioned type wherein the last-to-close end of the bridging contact of adjacent switch poles is located at opposite ends of the respective poles to further inhibit phase-to-phase flashover of the electric arc. Also provided in the multi-pole embodiment is a delayed-closing contact in one pole of the switch for effecting single phasing of a short circuit current for a brief time interval during which current limiting fuses begin to interrupt the circuit.

BRIEF DESCRIPTION OF THE DRAWING

The single FIGURE of the drawing is a schematic diagram of multi-pole, double break rotary switch incorporating the contact sequencing arrangement of this invention.

DESCRIPTION OF THE PREFERRED EMBODIMENT

Referring to the drawing, the switch of this invention is preferably a multi-pole, multi-phase rotary disconnect or safety switch. As can be seen in the drawing, the switch comprises three movable bridging contacts 2 which are each received within a contact retaining pocket 4*a* of a rotatably journaled shaft 4. One end of the shaft 4 has connection with an operating mechanism 6 which has a manually movable operating lever 8. The operating mechanism 6 is preferably an overcenter snap action type which imparts rapid rotational movement in either direction to the shaft 4 and bridging contact blades 2.

Associated with each bridging contact 2 is a pair of stationary contacts 10 and 12. Each stationary contact 12 is arranged to be closer to the respective bridging contact 2 than is the stationary contact 10 associated therewith, thereby to effect engagement of bridging contact 2 with stationary contact 12 before the respective bridging contact engages the respective contact 10. With this arrangement, contact is fully established between bridging contact 2 and stationary contact 12 prior to the time that the opposite end of bridging contact 2 engages stationary contact 10, and as a result, arcing occurs only at the point of engagement of bridging contact 2 with stationary contact 10. Thus, only one arc is present in this design as opposed to two arcs in conventional simultaneously closing contact designs and therefore the arcing energy dissipated is reduced by one-half.

Each stationary contact 10 and 12 is provided with a wiring terminal 10*t* and 12*t*, respectively. As seen in the drawing, the switch of this invention is connected to a three phase supply wherein line L1 is connected to terminal 10*t* of the left-hand switch pole, line L2 is connected to terminal 12*t* of the center switch pole and line L3 is connected to terminal 10*t* of the right-hand switch pole. The load side terminals of each switch pole are connected to overload protective apparatus which commonly comprises fuses 14 which are preferably of the current limiting type. Wiring terminals 16 are provided at the load-side end of fuses 14 for connection to the downstream wiring and load device.

To prevent or reduce any tendency for phase-to-phase flashover failure when arcing occurs, the contacts 10 and 12 of the center pole, or center phase, of the switch of this invention are reversed with respect to the respective stationary contacts of the outer two poles. Accordingly, arcing of the center pole occurs adjacent the lower or load end of that pole whereas arcing of the outer two poles occurs at the upper or line side thereof. This staggered arrangement provides a greater phase-to-phase failure distance for the arc.

Conventional disconnect and safety switches close all three poles simultaneously as a matter of design practice to assure that single phasing will not occur on switch closing. However, when conventional switches close on a fault current condition, the switch and downstream wiring and devices experience the highest level of fault current. As an alternative to this, the switch of this invention may be provided with a late closing contact 10*a*. This contact is spaced farther away from bridging contact 2 than are the other contacts 10 and therefore the circuit of the right-handmost phase is completed one or two milliseconds after closing of the circuits of the other phases. With this approach, the short circuit is in a single phase mode for the time during which current limiting fuses 14 or the like of the disconnect or safety switch begin to interrupt the circuit. This results in minimized damage to the device and to the downstream wiring and devices.

The foregoing describes a disconnect or safety switch wherein electrical arcing and the energy dissipated thereby may be readily and easily reduced and controlled by the arrangement of the switch contacts to effect a sequenced closing thereof. Moreover, a staggered arrangement of the contacts effects sequential closing at alternate ends of adjacent switch poles to increase the phase-to-phase failure distance for the arc, and the late closing contact provides single phasing for a small time interval during which current limiting fuses begin to interrupt the circuit, thereby to prevent downstream devices from being subjected to short circuit fault currents. While the invention has been disclosed in a preferred embodiment, it is to be understood that it is susceptible of various modifications without departing from the scope of the appended claims.

We claim:

1. In a multi-pole double break electric switch having a plurality of bridging contacts disposed in spaced side-by-side relation along a rotational axis and rotatable in unison for movement into and out of bridging engagement at opposite ends thereof with respective pairs of stationary contacts associated with said bridging contacts, each said bridging contact and respective associated pair of stationary contacts defining a switch pole, said contacts of each said pair being arranged to provide one stationary contact which is engaged by said respective bridging contact before the other stationary contact of said pair, the improvement comprising alternately arranging said pairs of stationary contacts for adjacent switch poles such that respective said one contacts of adjacent contact pairs are disposed at opposite ends of respective bridging contacts.

2. In a multi-pole double break electric switch having a plurality of bridging contacts disposed in spaced side-by-side relation along a rotational axis and rotatable in unison for movement into and out of bridging engagement at opposite ends thereof with respective pairs of stationary contacts associated with said bridging contacts, each said bridging contact and respective associated pair of stationary contacts defining a switch pole, said contacts of each said pair being arranged to provide one stationary contact which is engaged by said respective bridging contact before the other stationary contact of said pair, the improvement comprising arranging said contacts such that said other stationary contact in one pole is engaged by its respective bridging contact after said other stationary contacts of other poles are engaged by their respective bridging contacts.

3. In a multi-pole double break electric switch having a plurality of bridging contacts arranged in spaced side-by-side relation rotatable in unison for movement into and out of engagement with pairs of stationary contacts associated with each bridging contact, one stationary contact of each said pair being positioned for engagement by a corresponding end of a respective bridging contact before an opposite end of said respective associated bridging contact engages the other stationary contact of the associated pair, the improvement comprising alternately positioning said respective one stationary contact of adjacent pairs of said stationary contacts at respective opposite ends of said associated bridging contacts.

4. The invention defined in claim 3 wherein said switch is a three-pole device having three bridging contacts and associated pairs of stationary contacts, said one stationary contact of a central pole of said switch being positioned at an opposite end of said bridging contact associated therewith than are said one stationary contacts associated with respective bridging contacts of outer poles of said switch.

5. The invention defined in claim 3 wherein said bridging contact, when moved into bridging engagement with said pair of stationary contacts, is in sliding contact with said one stationary contact before said opposite end thereof engages the other of said stationary contacts.

* * * * *